US005538651A

United States Patent [19]

Grisso et al.

[11] Patent Number: 5,538,651

[45] Date of Patent: Jul. 23, 1996

[54] ADDITIVE TO IMPROVE FLUIDITY OF OIL SOLUTIONS OF SHEARED POLYMERS

[75] Inventors: Bryan A. Grisso, Wickliffe; Richard M. Lange, Euclid, both of Ohio

[73] Assignee: The Lubrizol Corporation, Wickliffe, Ohio

[21] Appl. No.: 491,648

[22] Filed: Jun. 19, 1995

[51] Int. Cl.[6] ..... C10M 143/14; C10M 135/20

[52] U.S. Cl. ..... 508/306; 585/10; 585/12; 508/473; 508/467; 508/567; 508/569

[58] Field of Search ..... 252/45

[56] References Cited

U.S. PATENT DOCUMENTS

| | | | |
|---|---|---|---|
| 2,466,301 | 4/1949 | Haworth et al | 260/30.8 |
| 2,510,808 | 6/1950 | Frolich | 260/30.8 |
| 3,000,866 | 9/1962 | Tarney | 260/80.5 |
| 3,093,621 | 6/1963 | Gladding | 260/80.5 |
| 3,661,822 | 5/1972 | Lee | 260/23.5 |
| 3,772,169 | 11/1973 | Small et al. | 252/56 R |
| 3,944,491 | 3/1976 | Baldwin | 252/45 |
| 4,110,235 | 8/1978 | Waldbillig et al. | 252/51.5 R |
| 4,119,550 | 10/1978 | Davis et al. | 252/45 |
| 4,162,985 | 7/1979 | Holubec | 252/45 |
| 4,217,233 | 8/1980 | Michaelis | 252/45 |
| 4,372,862 | 2/1983 | Miller | 252/51.5 A |
| 4,372,863 | 2/1983 | Elliott et al. | 252/51.5 A |
| 4,552,930 | 11/1985 | Hirota et al. | 525/333.8 |
| 4,620,048 | 10/1986 | Ver Strate et al. | 585/10 |
| 4,710,273 | 12/1987 | Okamoto | 252/45 |
| 4,839,069 | 6/1989 | Born et al. | 252/45 |
| 4,873,005 | 10/1989 | Hyde | 252/35 |
| 4,933,099 | 6/1990 | Ver Strate | 252/51.5 R |
| 5,070,131 | 12/1991 | Rhodes et al. | 524/484 |
| 5,196,619 | 3/1993 | Sun et al. | 585/2 |
| 5,270,369 | 12/1993 | Willcox et al. | 524/236 |
| 5,294,728 | 3/1994 | Emmons et al. | 558/255 |

OTHER PUBLICATIONS

Smalheer, C. V., et al, "Lubricant Additives", p. 1–11, 1967.

*Primary Examiner*—Ellen M. McAvoy

*Attorney, Agent, or Firm*—Joseph P. Fischer; Frederick D. Hunter; James L. Cordek

[57] ABSTRACT

A composition comprising (A) an ethylene-alpha olefin-bicyclic non-conjugated diene copolymer, wherein the alpha olefin contains from 3 to about 24 carbon atoms; (B) at least one organic sulfur containing compound selected from the group consisting of mercaptans and disulfides; and (C) a major amount of diluent; wherein the sulfur-containing compound (B) is present in amounts ranging from about 0.1% to about 15% by weight relative to the weight of the copolymer (A). This invention also relates to a method of shearing a composition comprising (A) an ethylene-alpha olefin-bicyclic non-conjugated diene copolymer and (C) a diluent, the improvement which comprises reducing or preventing the formation of gel-like particles on shearing by intimately mixing with said copolymer prior to shearing an amount of (B) an organic sulfur containing compound selected from the group consisting of mercaptans and disulfides in an amount sufficient to inhibit formation of said gel-like particles. The invention also relates to lubricating oil compositions containing the compositions of the invention.

33 Claims, No Drawings

ADDITIVE TO IMPROVE FLUIDITY OF OIL SOLUTIONS OF SHEARED POLYMERS

FIELD OF THE INVENTION

This invention relates to viscosity improvers for lubricating oil compositions. This invention also relates to polymeric compositions which have been subjected to shearing.

BACKGROUND OF THE INVENTION

The viscosity of oils of lubricating viscosity is generally dependent upon temperature. As the temperature of the oil is increased, the viscosity usually decreases and as the temperature is reduced, the viscosity usually increases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with change in temperature. The fluidity characteristics of the oil are improved.

Viscosity improvers are usually polymeric materials and are often referred to as viscosity index improvers. Ethylene-alpha olefin-diene copolymers are a well known member of the group of polymeric materials which find use as viscosity improvers for lubricating oils.

A wide variety of ethylene-alpha olefin-diene copolymers are available. Many of these copolymers, while eminently useful per se as materials which can be fabricated into a wide variety of products, do not possess properties which render them useful as viscosity improving additives for lubricating oils. A specific property of many such polymers that renders them unsuitable for use as viscosity improvers for lubricants is their extremely high molecular weight. Polymers of extremely high molecular weight are difficult to dissolve in a diluent, requiring excessive time to dissolve. While such polymers may provide desired kinematic viscosities at 100° C. at very low treating rates, they are very shear unstable, making the formulation of stay-in-grade lubricants virtually impossible, or formulations must contain sufficient polymer such that initial viscosity exceeds the desired grade so that the lubricant may meet minimum desired viscosity after shearing.

High molecular weight polymers often are susceptible to extreme shearing during use. Such shearing results in substantial loss of lubricating viscosity which can lead to increased engine wear and reduced engine life.

It has been found that many such high molecular weight polymers which are unsuitable for use as viscosity improvers for lubricating oil compositions may be modified by subjecting them to shearing. Shearing of polymers causes a reduction in molecular weight to levels which render them suitable for use as viscosity improvers for lubricating oils. Nevertheless, shearing of the polymers, particularly shearing conducted in solution, may create additional problems such as the formation of insoluble gelatinous or pituitous gels.

U.S. Pat. No. 3,772,169 relates to handling problems associated with oil solutions of hydrogenated butadiene-styrene copolymers. It is noted that at high concentration of polymer in oil (e.g., 20–25% weight) restricted flow is encountered, while at lower concentrations (less than 20 weight percent, e.g., 10 weight percent), on storage the polymer-oil concentrates tend to form a gel. The patent teaches that the addition of additional polymer compounds eliminates or significantly reduces gelation of the concentrates.

U.S. Pat. No. 2,510,808 relates to synthetic polymers, particularly curable synthetic polymers of rubbery character and especially to a means for adjusting molecular weight and plasticity of rubbery polymers for maximum ease of processing. Milling is one means for adjusting the molecular weight of such polymers. In particular, polymers of isobutylene with polyolefins such as butadiene or isoprene, especially those of molecular weight in excess of 70,000, are difficult to mill because of low fluidity and high elasticity. This problem is addressed by treating the polymer with an aliphatic mercaptan and milling at elevated temperature until the desired viscosity is attained.

U.S. Pat. No. 2,466,301 relates to a method of plasticizing a rubbery copolymer having unsaturation greater than 0.5 mole percent and prepared by reacting isobutylene with a conjugated di-olefin having 4–6 carbon atoms in the molecule, which method comprises treating said polymer with an aryl mercaptan as a plasticizer. This treatment improves mechanical processing of the polymers.

U.S. Pat. No. 4,110,235 relates to improving the color and viscosity stability of ethylene-alpha olefin copolymer viscosity improvers for mineral oil lubricants. This patent teaches the use of N,N'-bis (2-OH-5-alkylbenzyl)-α-Ω-diamino alkanes or metal salts thereof as viscosity and color stabilizers in compositions containing ethylene-alpha olefin copolymers.

In U.S. Pat. No. 4,933,099 it is noted that ethylene terpolymers which contain dienes, e.g., 5-vinyl-2-norbornene or ethylene tetrapolymers containing both 1,4-hexadiene and 2,5-norbornadiene are not suitable for mechanical degradation as by mastication in the presence of air or oxygen whereby oxidation occurs since this technique produces excessive amounts of polymeric gel particles which are oil insoluble. As a solution, the patent relates to the use of ethylene copolymers also containing a $C_3$ to $C_{18}$ higher alpha olefin and from 1–25 weight percent of alkyl norbornene having from 8–28 carbon atoms.

U.S. Pat. No. 4,873,005 relates to extrusion lubricating compositions for vinyl halide resins comprising mixtures of hydrocarbon wax, group II or lead salts of fatty acids and organic mercaptans.

U.S. Pat. No. 5,270,369 relates to a composition comprising a polyolefin and a hydroxyl amine having improved clarity and viscosity. The patent further describes a method of reducing viscosity and improving clarity of polyolefins wherein the process comprises visbreaking in the presence of a hydroxyl amine.

As noted above, shearing may be intentional, i.e., when it is desired to reduce the molecular weight of a polymer. Shearing may take place during use, e.g., when the polymer is present in a lubricating oil composition employed in an environment where it is subjected to shear and elevated temperature. In either event, the formation of insoluble gel-like components upon shearing is undesirable.

Accordingly, it is desirable to provide compositions that reduce the extent of loss of viscosity of lubricating oil compositions as temperatures are increased.

An object of this invention is to provide novel viscosity improvers lubricating oil compositions.

Another object is to provide a means for utilizing a broad range of available polymeric compositions for use as viscosity improvers for lubricating oil compositions.

A further object is to provide a method for adjusting the molecular weight of polymers such that they may be used as viscosity improvers for lubricating oil compositions without the development of undesirable side effects.

A particular object of this invention is to provide a polymer containing composition which, on shearing, does not develop, or develops only a minor, insignificant amount, of oil-insoluble gelatinous particles.

A further object is to provide a method for preventing or reducing the tendency of polymers to form undesirable gelatinous particles when the polymers are sheared in solution.

Another object is to provide lubricating oil compositions containing as an additive polymeric compositions which are resistant to formation of undesirable gelatinous particles on shearing.

Yet another object is to provide lubricating oil compositions containing polymeric compositions which have been subjected to shearing but which do not contain undesirable gelatinous particles.

Other objects will in part be obvious in view of this disclosure and will in part appear hereinafter.

SUMMARY OF THE INVENTION

The present invention is directed to a composition comprising (A) an ethylene-alpha olefin-bicyclic non-conjugated diene copolymer, wherein the alpha olefin contains from 3 to about 24 carbon atoms;

(B) at least one organic sulfur containing compound selected from the group consisting of mercaptans and disulfides; and (C) a major amount of diluent;

wherein the sulfur-containing compound (B) is present in amounts ranging from about 0.1% to about 15% by weight relative to the weight of the copolymer (A).

In another embodiment, this invention relates to a method of shearing a composition comprising (A) an ethylene-alpha olefin-bicyclic non-conjugated diene copolymer and (C) a diluent, the improvement which comprises reducing or preventing the formation of gel-like particles on shearing by intimately mixing with said copolymer prior to shearing an amount of (B) an organic sulfur containing compound selected from the group consisting of mercaptans and disulfides in an amount sufficient to inhibit formation of said gel-like particles.

This invention also relates to lubricating oil compositions comprising the polymeric compositions of this invention.

DETAILED DESCRIPTION OF THE PREFERRED EMBODIMENTS

The present invention relates to a composition comprising an ethylene-alpha olefin-bicyclic non-conjugated diene copolymer, an organic sulfur-containing compound and a diluent. In another embodiment the invention relates to an improved method of shearing a composition comprising an ethylene-alpha olefin-bicyclic non-conjugated diene copolymer and a diluent which comprises reducing or preventing the formation of gel-like particles on shearing by mixing with said copolymer solution prior to shearing an amount of an organic sulfur-containing compound, and to the sheared product obtained thereby. Lubricating compositions containing the compositions of this invention are also contemplated.

In the context of this invention, the term "copolymer" means a polymer derived from three different types of monomers, specifically, ethylene, an alpha olefin and a bicyclic non-conjugated diene. The alpha olefin and the diene components may each be a single, substantially pure monomer or each may comprise a mixture consisting of isomers and/or homologues.

(A) The Ethylene-Alpha Olefin-Bicyclic Non-Conjugated Diene Copolymer

The polymeric compound (A) is an ethylene-alpha olefin-bicyclic non-conjugated diene copolymer, wherein the alpha olefin contains from 3 to about 24 carbon moths. These copolymers most often will have a number average molecular weight ranging from about 20,000 to about 500,000, preferably from about 50,000 to about 200,000. In another embodiment, the number average molecular weight (Mn) ranges from about 70,000 to about 350,000. These polymers generally have a relatively narrow range of molecular weight as represented by the polydispersity value $M_w/M_n$ where $M_w$ represents weight average molecular weight. Typically, the polydispersity values are less than 10, more often less than 6 and preferably less than 4, often between 2 and 3.

The copolymers (A) are generally oil soluble or dispersible. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The compositions of this invention generally comprise a minor amount, that is, less than 50% by weight of the copolymer (A). More often, the compositions comprise from about 0.5 to about 25% by weight of copolymer (A), preferably from 2 to about 15%, more preferably from 4 to about 10% by weight. For the most part, the amount of polymer present in the composition depends upon the solubility of the polymer in the diluent and upon the nature of the solution so obtained. While it is often possible to incorporate very large amounts (e.g., greater than 30% by weight) of polymer in the diluent, the resulting solution may be so viscous as to preclude handling by such means as pumps, mechanical stirrers, etc.

As noted hereinabove, the alpha olefin component of the copolymer (A) is derived from alpha olefins containing from 3 to about 24 carbon atoms, frequently from 3 to about 12 carbon atoms, more often from 3 to about 8 carbon atoms. In an especially preferred embodiment, the alpha olefin is propylene or a butene. Most often, the alpha olefin is propylene. The alpha-olefin component may be derived from mixtures of alpha-olefins, many of which are commercially available.

The copolymer also comprises segments derived from a bicyclic non-conjugated diene. The diene is frequently a bridged diene. Representative of such dienes are dicyclopentadiene and 5-ethylidene-2-norbornene.

The copolymer (A) typically contains from about 20% to about 80% by weight of units derived from ethylene and from about 0.001% to about 8% by weight of the monomeric segments of the copolymer are derived from the diene. In one preferred embodiment, the copolymer contains from about 45% to about 80% by weight of units derived from ethylene and from about 1% to about 4% by weight of units derived from diene, the remainder being units derived from alpha olefin, preferably lower alpha olefins, that is those containing from 3 to about 7 carbon atoms, and especially propylene.

Molecular weights of the copolymer (A) of the present invention are typically given as number average molecular weight ($M_n$) which can be determined by techniques which are well known to those of skill in the art. Such techniques include, but are not limited to, vapor phase osmometry (VPO) and gel-permeation chromatography (GPC), otherwise known as size-exclusion chromatography. Molecular weights of the copolymers employed in the instant invention are usually determined by GPC employing polystyrene standards. These and other procedures are described in numerous publications including:

P. J. Flory, "Principles of Polymer Chemistry" Cornell University Press (1953), Chapter VII, pp 266–316, and "Macromolecules, an Introduction to Polymer Science", F. A. Bovey and F. H. Winslow, Editors, Academic Press (1979), pp 296–312.

W. W. Yau, J. J. Kirkland and. D. D. Bly, "Modern Size Exclusion Liquid Chromatography", John Wiley and Sons, New York, 1979.

A measurement which is complimentary to a polymer's molecular weight is the melt index (ASTM D-1238). Polymers of high melt index generally have low molecular weight, and vice versa.

Mooney viscosity (ASTM Procedure D-1646-87) relates indirectly to polymer molecular weight. All other factors being equal, as molecular weight of the polymer increases, so too does the Mooney viscosity.

ASTM procedures D-1238 and D-1646-87 are described in detail in the Annual Book of ASTM Standards, Sections 8 and 9, respectively, ASTM, Philadelphia, Pa., U.S.A.

When the molecular weight of the ethylene copolymer is greater than desired, it may be reduced by techniques known in the art. Such techniques include mechanical shearing of the polymer employing masticators, homogenizers, roll mills, extruders and the like. Oxidative or thermal shearing or degrading techniques are also useful and are known. Ultrasonic shearing methods are known and are useful. Details of numerous procedures for shearing polymers are given in U.S. Pat. No. 5,348,673 which is hereby incorporated herein by reference for relevant disclosures in this regard.

Useful copolymers are typically substantially saturated, including hydrogenated, copolymers. By substantially saturated is meant that no more than about 5% of the carbon to carbon bonds in the polymer are unsaturated, often no more than 1%.

The copolymers (A) used in this invention are materials well known in the art. Many are commercially available, for example, an elastomeric copolymer of ethylene, propylene and 5-ethylidene, 2-norbornene is marketed under the trade name VISTALON by Exxon Chemical Company, New York.

The preparation of suitable copolymers used in the practice of this invention is known in the art. Exemplary are those prepared by means of Ziegler-Natta catalysts described in, for example, U.S. Pat. Nos. 2,933,480; 3,000,866, 3,093,621; and 3,151,173.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "Principles of Polymer Chemistry", Cornell University Press, Ithaca, N.Y. (1953), "Kirk-Othmer Encyclopedia of Chemical Technology", 3rd edition, Vol 8 (Elastomers, Synthetic, and various subheadings thereunder), John Wiley and Sons, New York (1979).

Each of the above-mentioned books and patents is hereby expressly incorporated herein by reference for relevant disclosures contained therein.

(B) The Organic Sulfur-Containing Compound

The composition of this invention also employs an organic sulfur-containing compound. The sulfur-containing compound is selected from the group consisting of mercaptans, including mercapto alkanoic acids and esters thereof and disulfides. Typically, the organic sulfur-containing compounds are aliphatic, usually containing alkyl groups having from 4 to about 24 carbon atoms. In an especially preferred embodiment, the sulfur-containing compound is a mercaptan and preferably an aliphatic mercaptan. Especially preferred is where the aliphatic mercaptan is an alkyl mercaptan, preferably a primary alkyl mercaptan, more preferably a normal alkyl mercaptan containing from 4 to about 24 carbon atoms. Often, the aliphatic groups contain up to about 16 carbon atoms, more often from about 8 to about 12 carbon atoms.

The sulfur-containing compound is present in the polymer containing composition of this invention in amounts sufficient to reduce or prevent formation of gel-like particles when the copolymer is subjected to shearing. These amounts usually range from about 0.1% to about 15% by weight relative to the weight of the copolymer (A), more often from about 1% to about 8% by weight relative to the weight of the copolymer (A).

(C) The Diluent

Shearing of the polymer composition is most conveniently conducted in the presence of a diluent. The diluent is generally one in which the copolymer displays good solubility, typically being soluble in amounts of at least about 1% by weight, preferably in amounts of at least 4% and most preferably in amounts of at least 7%. For reasons of economics, it is generally preferred to have the maximum amount of polymer dissolved in the diluent, consistent with the ability to handle and shear the polymer. The compositions of this invention contain a major amount of diluent relative to the amount of polymer. This means the composition contains at least 50% by weight of diluent relative to the weight of polymer. Typically, for every 1 to 30 parts by weight of copolymer (A) the composition comprises 99 to 70 parts by weight of diluent (C).

As noted hereinabove, the copolymer must have reasonable solubility in the diluent (C). Diluent-polymer solutions containing insoluble polymer are undesirable, as are those where crystallization and precipitation of polymer from solution occur. Typical diluents are organic in nature. While a wide variety of organic diluents are suitable for preparing compositions of this invention, it is generally desirable that the diluent be an oil of lubricating viscosity as described in greater detail hereinafter. When the diluent is an oil of lubricating viscosity, this avoids the need to remove volatile components after the polymer is sheared and before the polymer is incorporated into a lubricating oil composition.

(D) The Anti-Oxidant

The compositions of this invention may also comprise (D) an anti-oxidant. Numerous anti-oxidants are known in the art such as phenols, including alkylated phenols, for example di-t-butyl phenols, aryl amines such as diphenylamines and alkylated diphenylamines and a variety of alkyl aromatic compounds.

(E) The Pour-Point Depressant

The compositions of this invention also may contain a pour point depressant. Such materials are well known to those of skill in the art; see for example, page 8 of "Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures. Examples include polyalkylmethacrylates, vinyl acetate-fumarate copolymers and maleic anhydride-styrene copolymers and esters thereof.

The compositions of this invention can be prepared by methods well-known to those of skill in the art. These methods usually involve blending together, usually with heating, (A) the polymer and (C) the diluent and (B) the organic sulfur compound. Such blending is readily accomplished employing a mechanical mixer such as a blade type mixer, circulating mixers wherein the components are pumped to effect mixing, extruders, homogenizers, etc. Simple blade type stirrers are easy to use and are preferred.

The order of blending is usually not a critical feature of this invention; however, when mixing is conducted under high shear conditions, the sulfur compound should be present with the polymer. When low shear methods of blending are used, it is often convenient to first prepare a solution of polymer in diluent, then add the sulfur compound.

Blending is often conducted under an inert atmosphere, usually a nitrogen atmosphere. However, blending can be accomplished under normal atmospheric conditions.

Blending may be facilitated by heating. Moderate heating is often useful. When blending is to be conducted at elevated temperature, or when the blend will be subjected to shearing under conditions that promote oxidation, an antioxidant may be, and often is employed. Useful antioxidants include those described hereinabove as component (D).

As noted hereinabove, the compositions of this invention may also contain a pour point depressant as described herein as component (E). While the pour point depressant may be added at any stage of blending, it often added after completion of blending of components (A)-(C), and if used, (D). Since the pour point depressant is often a polymeric material which may be susceptible to shearing, it is often not incorporated into compositions of this invention prior to shearing to adjust molecular weight.

Blending may be conducted at temperatures ranging from ambient up to the lowest decomposition point of any of the ingredients in the composition. More often, blending is done at temperatures ranging from about 50° C. to about 200° C., or typically from about 80° C. to about 150° C. Commonly, temperatures ranging from about 90° C. to about 130° C. are sufficient to effect blending.

EXAMPLE 1

A composition, typical of those contemplated by this invention, is prepared by mixing with efficient stirring for 1 hour in a container, at 95°–100° C. under a nitrogen atmosphere, 2494 parts of a solution of 8.5% by weight of a commercial ethylene polymer having an ethylene/propylene weight ratio of about 56/44 and containing about 1.4% by weight of dicyclopentadiene based on total polymer, 91.4% by weight mineral oil (solvent refined 100 neutral) and 0.1% by weight 2,6-di-t-butyl, 4-methyl-phenol, with 6.25 parts n-dodecyl mercaptan. The solution is the desired product.

EXAMPLE 2

A similar blend is prepared except 99.88 parts of polymer solution and 0.12 parts of n-dodecyl mercaptan are used.

EXAMPLE 3

Another blend is prepared as in Example 1 except t-dodecyl mercaptan replaces n-dodecyl mercaptan.

EXAMPLE 4

A blend is prepared as in Example 1 replacing the n-dodecyl mercaptan with an equal weight of di-n-dodecyl disulfide.

EXAMPLE 5

A blend is prepared as in Example 1 replacing the ethylene polymer with another having an ethylene/propylene weight ratio of about 59/41 and containing about 3.1% by weight of dicyclopentadiene based on total polymer.

EXAMPLE 6

A blend is prepared as in Example 5 except 99.5 parts of polymer solution and 0.50 parts n-dodecylmercaptan are used.

EXAMPLE 7

A blend is prepared as in Example 1 replacing the ethylene polymer with another having an ethylene/propylene weight ratio of about 51/49 and containing about 2.0% by weight dicyclopentadiene based on total polymer.

EXAMPLE 8

A blend is prepared as in Example 7 except 99.5 parts of polymer solution and 0.5 parts n-dodecyl mercaptan are used.

As noted hereinabove, this invention also contemplates a method of shearing a composition comprising (A) an ethylene-alpha olefin-bicyclic-non-conjugated diene copolymer and (C) a diluent. The method comprises an improvement comprising reducing or prevent the formation of gel-like particles on shearing by intimately mixing with said copolymer prior to shearing an amount of (B) an organic sulfur containing compound selected from the group consisting of mercaptans and disulfides in an amount sufficient to inhibit formation of said gel-like particles.

The copolymer (A), the organic sulfur-containing (B) and the diluent (C) employed in the method of this invention are those described hereinabove.

As noted, shearing of the polymer may be intentional, for example to reduce the molecular weight thereof to a level more acceptable for use as a viscosity improver for lubricating oil compositions. Shearing of the polymer may also be incidental to its use in a lubricating composition which is subjected to shearing.

When the shearing is intentional, it is conducted under controlled conditions in devices such as extruders, masticators, homogenizers, milling devices and pumps.

Particularly useful is a positive-displacement, plunger pump equipped with a homogenizing valve assembly. Using this device, the product enters the valve area at high pressure and low velocity. As the product enters the controllable, close clearance area between the valve and the valve seat, there is a rapid increase in velocity with a corresponding decrease in pressure to the vapor pressure of the product. Upon leaving the valve seat area, product velocity decreases with an increase in pressure sufficient to cause cavitation of the product. The intense energy release and turbulence associated with cavitation provides a shearing action and disruption of product particles. Such a device is available from APV Gaulin, Inc., Wilmington, Mass., USA The shearing of the polymer is frequently conducted under oxidizing conditions, for example under normal atmospheric conditions or in an oxygen-enriched environment. Under oxidizing conditions, it is usually desirable that the composition undergoing shear also contain (D) an antioxidant as defined hereinabove.

Solutions containing 8.5% by weight of the polymer of the indicated example and 0.1% by weight of 2,6-di-t-butyl, 4-methyl-phenol in a 100 neutral solvent refined mineral oil and various amounts of n-dodecyl mercaptan are subjected to the indicated number of passes through a Gaulin 15M homogenizer at 8000 pounds per square inch (psi) at room temperature. The effect of the invention is illustrated by the results set forth in the following Table (viscosities are reported in Centistokes (ASTM D-445) @100° C.):

TABLE I

| Polymer | n-$C_{12}$ SH % wt | # passes | Viscosity | Appearance |
|---|---|---|---|---|
| Example 1 | 0 | 0 | 1088 | Clear |
| Example 1 | 0 | 1 | 986 | Gel |
| Example 1 | 0.25 | 0 | 1079 | Clear |
| Example 1 | 0.25 | 1 | 818 | Clear |
| Example 1 | 0.25 | 2 | 736 | Clear |
| Example 1 | 0.12 | 0 | 1088 | Clear |
| Example 1 | 0.12 | 1 | 933 | Sl. gel (haze) |
| Example 1 | 0.12 | 2 | 841 | Sl. gel (haze) |
| Example 5 | 0 | 0 | 887 | Clear |
| Example 5 | 0 | 1 | not measured | Heavy gel |
| Example 5 | 0.25 | 0 | 874 | Clear |
| Example 5 | 0.25 | 1 | 764 | Sl. gel |
| Example 5 | 0.25 | 2 | 612 | Sl. gel |
| Example 5 | 0.50 | 0 | 803 | Clear |
| Example 5 | 0.50 | 1 | 603 | Clear |
| Example 5 | 0.50 | 2 | 581 | Clear |
| Example 7 | 0 | 0 | 875 | Clear |
| Example 7 | 0 | 1 | not measured | Heavy gel |
| Example 7 | 0 | 2 | not measured | Heavy gel |
| Example 7 | 0.25 | 0 | 876 | Clear |
| Example 7 | 0.25 | 1 | 671 | Sl. gel |
| Example 7 | 0.25 | 2 | 594 | Sl. gel |
| Example 7 | 0.50 | 0 | 862 | Clear |
| Example 7 | 0.50 | 1 | 635 | Clear |
| Example 7 | 0.50 | 2 | 555 | Clear |
| Ethylene-propylene- | 0 | 0 | 859 | Clear |
| 1,4-hexadiene | 0 | 1 | 548 | Clear |
| (Ortholeum 2052, | 0 | 2 | 598 | Clear |
| DuPont) | 0 | 3 | 511 | Clear |

It is apparent that the addition of the mercaptan results in elimination or significant reduction of gel formation. It is also apparent that the diene component has an influence on the tendency to form gel on shearing.

The Oil of Lubricating Viscosity

The lubricating compositions and methods of this invention employ an oil of lubricating viscosity, including natural or synthetic lubricating oils and mixtures thereof. Mixtures of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing acids, polymeric tetrahydrofurans, alkylated diphenyloxides and the like.

Hydrotreated naphthenic oils are also used.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III., U.S. Pat. No. 4,326,972, European Patent Publication 107,282, and A. Sequeria, Jr., Lubricant Base Oil and Wax Processing, Chapter 6, Marcel Decker, Inc., New York (1994), each of which is hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, the compositions of this invention may contain minor amounts of other components. The use of such additives is optional and the presence thereof in the compositions of this invention will depend on the particular use and level of performance required. These "other additives" are usually present in lubricating oil compositions containing the polymer-containing compositions of this invention. They are not often included in the polymer-containing compositions that are to be subjected to shearing. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed hereinabove, other additives that may optionally be used in the lubricating oils of this invention include, for example, detergents, dispersants, viscosity improvers, metal passivating agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, substantially hydrogenated diene polymers, polyalkyl styrenes, alkenylarenehydrogenated conjugated diene copolymers and polyolefins. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. Pat. Nos.:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. Pat. Nos. are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. Pat. Nos.:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated other additives may each be present in lubricating compositions of this invention at a concentration of as little as 0.001% by weight, usually ranging from about 0.01% to about 20% by weight, more often from about 1% to about 12% by weight. In most instances, they each contribute from about 0.1% to about 10% by weight.

The lubricating oil compositions of the present invention contain minor amounts of the copolymer-containing compositions of this invention. These are often amounts ranging from about 1% to about 29% by weight, more often from about 3% to about 10% by weight, even more often from about 5% to about 8% by weight.

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 0.1 to about 80% by weight of the compositions of this invention and may contain, in addition, one or more other additives known in the art or described hereinabove. Concentrations such as 15%, 20%, 30% or 50% or higher may be employed. Each component of an additive concentrate is present in amounts such that when diluted to form the finished lubricating oil composition each component is present in an amount sufficient to provide the desired level of performance.

The lubricating compositions of this invention usually contain sufficient amount of the compositions of this invention to supply from about 0.25% up to about 2% by weight of polymer, more often from about 0.5% to about 1.5%, more frequently from about 0.5% to about 1% by weight of polymer. The amount of concentrate containing the polymer will of course be proportionately greater, depending upon the amount of polymer present in the diluent. The lubricating compositions are prepared by combining ingredients, individually or from concentrates, in desired amounts and oil of lubricating viscosity to make the total 100 parts by weight.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is

1. A composition comprising (A) an ethylene-alpha olefin-bicyclic non-conjugated diene copolymer, wherein the alpha olefin contains from 3 to about 24 carbon atoms;

(B) at least one organic sulfur containing compound selected from the group consisting of mercaptans and disulfides; and (C) a major amount of a diluent;

wherein the sulfur containing compound (B) is present in amounts ranging from about 0.1% to about 15% by weight relative to the weight of the copolymer (A).

2. The composition of claim 1 wherein for every 1 to 30 parts by weight of copolymer (A) there are 99 to 1 parts by weight of diluent (C).

3. The composition of claim 1 wherein the alpha olefin contains from 3 to about 8 carbon atoms.

4. The composition of claim 1 wherein the diene is a bridged diene.

5. The composition of claim 1 wherein the diene is selected from the group consisting of dicyclopentadiene and 5-ethylidene-2-norbornene.

6. The composition of claim 1 wherein from about 0.001% to about 2% of the monomeric segments in the copolymer are derived from the diene.

7. The composition of claim 6 wherein from about 0.2% to about 1% of the segments in the copolymer are derived from the diene.

8. The composition of claim 1 wherein the copolymer has a number average molecular weight ranging from about 20,000 to about 500,000.

9. The composition of claim 8 wherein the number average molecular weight ranges from about 50,000 to about 200,000.

10. The composition of claim 8 wherein the number average molecular weight ranges from about 70,000 to about 350,000.

11. The composition of claim 1 wherein the copolymer contains from about 20% to about 80% by weight of units derived from ethylene.

12. The composition of claim 11 wherein the alpha olefin is selected from the group consisting of propylene and butylene.

13. The composition of claim 12 wherein the copolymer contains from about 45% to about 65% by weight of units derived from ethylene and from about 1% to about 5% by weight of units derived from the diene.

14. The composition of claim 1 wherein (B) the sulfur-containing compound is an aliphatic mercaptan.

15. The composition of claim 14 wherein the mercaptan is an alkyl mercaptan containing from about 4 to about 24 carbon atoms.

16. The composition of claim 15 wherein the mercaptan is a primary alkyl mercaptan.

17. The composition of claim 16 wherein (B) is a normal alkyl mercaptan containing from 4 to about 24 carbon atoms.

18. The composition of claim 1 containing from about 2% to about 5% by weight of the sulfur-containing compound (B) relative to the weight of the copolymer (A).

19. The composition of claim 1 wherein the sulfur containing compound (B) is present in amounts sufficient to reduce or prevent formation of gel-like particles when the copolymer is subjected to shearing.

20. The composition of claim 1 wherein the diluent (C) is an organic diluent.

21. The composition of claim 1 further comprising (D) an antioxidant.

22. The composition of claim 21 wherein the antioxidant is selected from the group consisting of phenols, aryl amines and alkyl aromatic compounds.

23. The composition of claim 1 further comprising (E) a pour point depressant.

24. The composition of claim 23 wherein the pour point depressant is selected from the group consisting of polymethacrylates, vinyl acetate-fumarate copolymers and maleic anhydride-styrene copolymers and esters thereof.

25. In a method of shearing a composition comprising (A) an ethylene-alpha olefin-bicyclic non-conjugated diene copolymer and (C) a diluent, the improvement which comprises reducing or preventing the formation of gel-like particles on shearing by intimately mixing with said copolymer prior to shearing an amount of (B) an organic sulfur containing compound selected from the group consisting of mercaptans and disulfides in an amount sufficient to inhibit formation of said gel-like particles.

26. The method of claim 25 wherein the composition further comprises (D) an antioxidant.

27. The method of claim 25 conducted in a positive-displacement, plunger pump equipped with a homogenizing valve assembly.

28. The method of claim 25 conducted in an extruder.

29. The method of claim 25 conducted under oxidizing conditions.

30. The composition sheared by the method of claim 25.

31. A lubricating oil composition comprising a major amount of an oil of lubricating viscosity and a minor amount of the copolymer composition of claim 1.

32. A lubricating oil composition comprising a major amount of an oil of lubricating viscosity and a minor amount of the copolymer composition of claim 23.

33. A lubricating oil composition comprising a major amount of an oil of lubricating viscosity and a minor amount of the composition of claim 30.

* * * * *